United States Patent [19]

Skibinski

[11] Patent Number: 4,843,661

[45] Date of Patent: Jul. 4, 1989

[54] DEVICE TO AID PERSONS RISING FROM A SEATED POSITION

[76] Inventor: Bernard J. Skibinski, 14117 Mapleridge, Detroit, Mich. 48205

[21] Appl. No.: 105,660

[22] Filed: Oct. 7, 1987

[51] Int. Cl.[4] ..... A61H 3/00

[52] U.S. Cl. ..... 5/81 R; 135/67

[58] Field of Search ..... 5/81 R, 81 B; 135/65, 135/67; 182/150

[56] References Cited

U.S. PATENT DOCUMENTS

| | | | |
|---|---|---|---|
| 2,582,143 | 1/1952 | Mass . | |
| 2,757,388 | 8/1956 | Chisholm | 135/65 |
| 2,878,078 | 3/1959 | Moultrop | 182/150 |
| 3,041,636 | 7/1962 | Twedt . | |
| 3,085,258 | 4/1963 | Wolferts | 135/67 |
| 3,259,427 | 7/1966 | Wiest | 5/81 R |
| 3,272,530 | 9/1966 | Klassen . | |
| 3,438,642 | 4/1969 | Kite et al. . | |
| 3,591,874 | 7/1971 | O'Kennedy | 5/81 R |
| 3,739,793 | 6/1973 | Wilson | 5/81 R |
| 4,157,593 | 6/1979 | Kristensson . | |
| 4,279,043 | 7/1981 | Saunders . | |
| 4,314,576 | 2/1982 | McGee | 135/67 |
| 4,474,202 | 10/1984 | Blechner | 135/67 |
| 4,510,633 | 4/1985 | Thorne . | |

*Primary Examiner*—Reinaldo P. Machado
*Attorney, Agent, or Firm*—Peter D. Keefe

[57] ABSTRACT

A portable assist to aid persons who have difficulty rising from a seated position including a platform having attached thereto two rotatable handles and an adjustable stabilizer which prevents the platform from pitching while the user pulls on the handles while in the act of getting up.

9 Claims, 1 Drawing Sheet

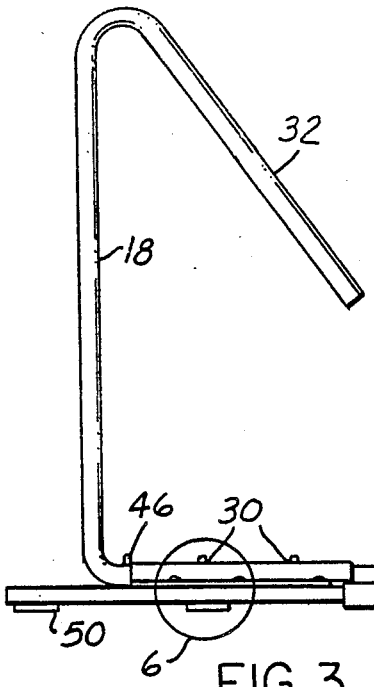
FIG. 1
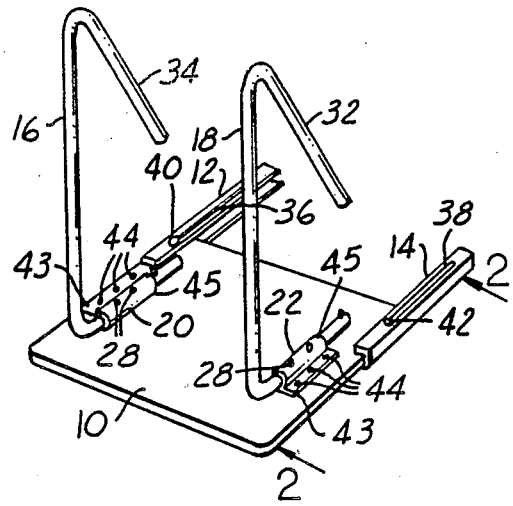
FIG. 2
FIG. 3
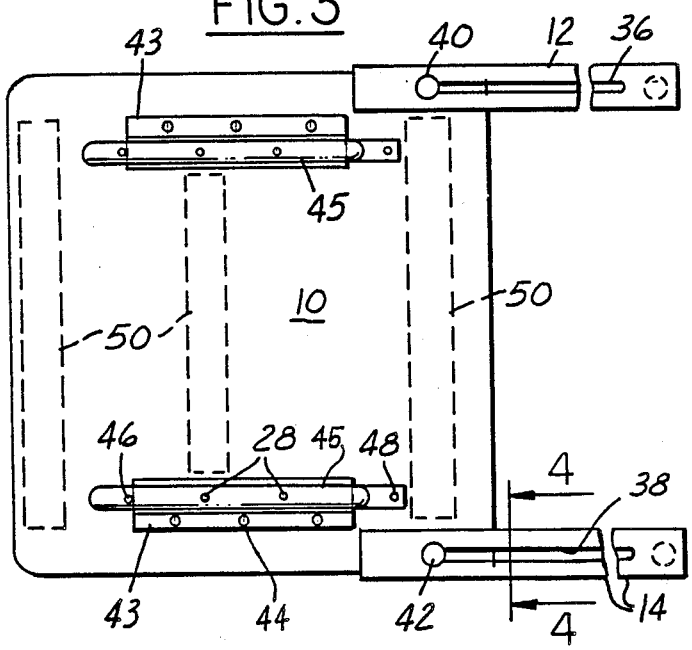
FIG. 5
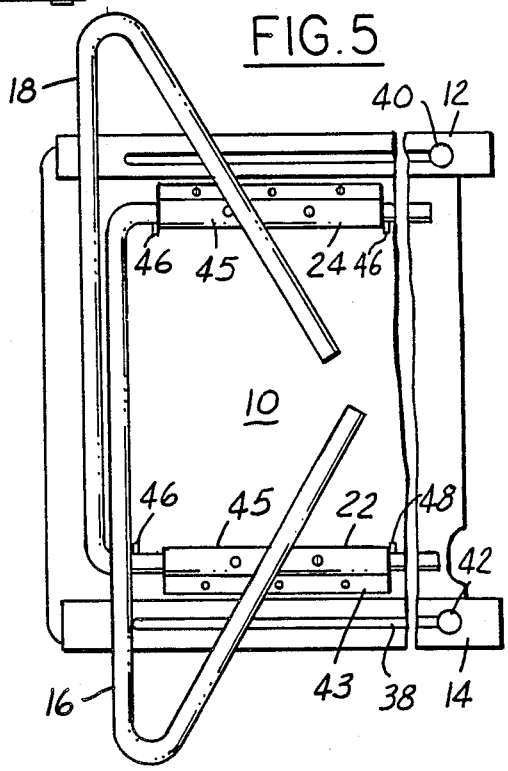
FIG. 4
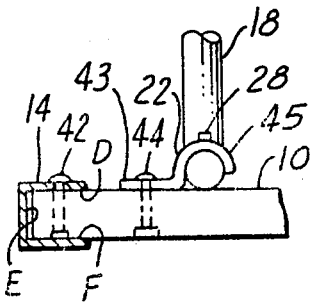
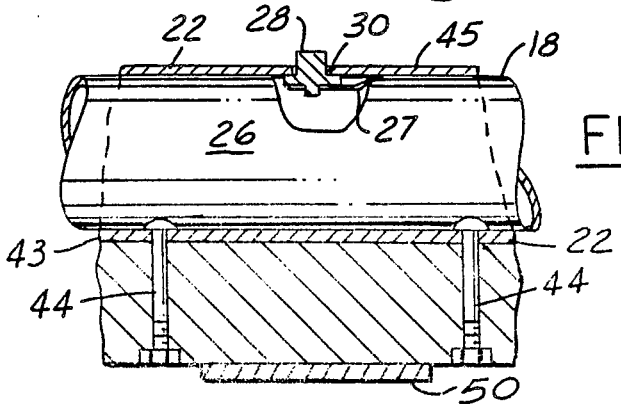
FIG. 6

DEVICE TO AID PERSONS RISING FROM A SEATED POSITION

BACKGROUND OF THE INVENTION

The invention relates to devices that assist people as they rise up from a seated position in a chair, more particularly to assists which are removably separate from the chair structure.

Many persons have difficulty rising from a seated position, because of an infirmity due to illness, advanced age, or other debilitation. This becomes of especial concern when chairs and couches are used, as the individual may be deeply seated in the cushioning, aggravating any difficulty in getting up.

Devices for assisting persons rising from a seated position are generally of two types. One type utilizes a mechanism within the seat itself which actually lifts up as the person rises from a seated position, thereby assisting him or her. These devices are expensive and only help people when they sit in those particular pieces of furniture that include the lifting mechanism. The other type, which encompasses the class of inventions to which the present invention appertains, utilizes a handle means to permit the seated person to grab hold of and pull on while rising. These devices have the advantage that they are not connected to any particular piece of furniture, and so may be employed wherever the individual may be seated.

Prior assist devices, such as U.S. Pat. Nos. 3,041,636 to Twedt, 3,272,530 to Klasses, and 4,157,593 to Kristensson, are rather complicated and are more particularly directed to infirm persons who are generally non-ambulatory, in that a retaining structure is provided to prevent the user from falling out of the device and dolly whells are provided for locomotion.

It is an object of the present invention to provide an assist for seated persons to aid in helping them rise in the form of an inexpensive, portable, foldable, simple device provided with easily reachable handles for the user to grab hold of while rising.

It is an additional object of the present invention to provide an assist to seated persons having handles to grab hold of enabling them to more easily rise, while maintaining simultaneously an unobstructed pathway through which users may walk while entering or leaving the immediate vicinity of the seat.

It is another object of the present invention to provide an assist to seated persons so that they may more easily rise that works efficiently with any type of seating, be that a chair, sofa, bed, or other structure on which a person may sit.

It is a further object of the invention to provide an assist for seated persons to aid them while rising which includes means to stabilize it against pitching up while the user pulls on the handles.

These and additional objects, advantages, features, and benefits of the invention will become apparent from the following specification.

SUMMARY OF THE INVENTION

The present invention is a portable, adjustable assist device for seated persons that aids in enabling them to rise to a standing position. The invention consists broadly of a platform having two handles which are rotatably attached thereto and stabilizers which are extendably attached to the platform, being extensible outward in the plane of the platform. The handles are separated from each other to allow a user to walk between them.

In operation, the user places the assist in front of a seat, rotates the handles into a raised position which is generally perpendicular to the platform surface, extends the stabilizers, positions the assist adjacent the seat, and sits down. To get up, the user grabs the handles, one in each hand, and pulls while rising up. The user can then walk directly across the platform and away from the seat in a normal fashion. The invention may then be removed in a manner opposite in sequence to the manner in which it was deployed.

BRIEF DESCRIPTION OF THE DRAWINGS

FIG. 1 is a perspective view showing the invention configured for deployment.

FIG. 2 is a side view of the invention as shown in FIG. 1, along lines 2—2.

FIG. 3 is a plan view of the invention as shown in FIG. 1.

FIG. 4 is a front detail view of the handle attachment to the platform according to the invention, along lines 4—4 in FIG. 3.

FIG. 5 is a plan view as in FIG. 3, showing the folded configuration of the present invention for transportation.

FIG. 6 is a detail view of the spring pin members as indicated by circle 6 in FIG. 2.

DETAILED DESCRIPTION OF THE PREFERRED EMBODIMENT

Referring now to the drawings, FIG. 1 shows the invention generally as it would be configured for deployment in front of a seat. A rigid, generally rectangular platform 10 is provided from which depends a set of stabilizers 12 and 14 as well as a set of handles 16 and 18. Each of the handles are rotatably attached to the platform by a part cylindrically shaped bracket member 20 and 22 respectively, which traps a portion, 24 and 26 respectively, of the handles rotatably in relation to the platform. Additionally, spring pins 28 are provided on the trapped portion of the handles which are spring biased outwardly from the handles. The spring pins 28 are receivable into apertures 30 provided on the bracket members for holding the handles in a generally perpendicular orientation relative to the platform 10. It is preferred that the spring pins be attached to the handles by use of a strip of spring steel 27, as shown in FIG. 6. The orientation for deployment of the invention relative to the seat to which it is to be used in conjunction with, is such as to permit the stabilizers to extend under the seat; that is, the stabilizers are directed toward the seat. The stabilizers ensure that the torque generated by a person in the act of rising, who is pulling on the handles, will not cause the platform to pitch up.

FIG. 2 shows generally the relative orientation between the platform, handles and stabilizers along line 2—2 in FIG. 1. It will be seen from inspection of the figures that the handles are designed to have a generally "U" shape. This is to ensure that the torque generated by the user in the act of rising does not bend or in any other way distort the handles. The handles are rotatably deployed into a generally perpendicular orientation relative to the platform when the spring pins insert into the apertures provided on the bracket members. In this way, a person seated in a customary manner can easily reach the handles by simply stretching his or her arms straight outward. It will be seen by reference to the figures, that the preferred shape of the handles includes a portion angled with respect to the platform at an angle other than ninety degrees. This aids in stabilizing the invention when the user pulls on the handles, as well as provides a section of the handle, respectively 32 and 34, that is slightly angled off from the vertical, making it a bit easier and more efficient for the user to grab hold of the pull on.

FIG. 3 is a top view of the invention. The stabilizers 12 and 14 are, respectively, provided with slots 36 and 38 running longitudinally along their axial length into which a pin or rivet 40 and 42 respectively insert. The pins 40 and 42 are fixedly attached to the platform and act as slidable fastening means for the attachment of the stabilizers to the platform. The length of the slots determine the maximum extenable length of the stabilizers. This length is determined by practical considerations of the torques generated by anticipated users, which recommends a length on the order of one to two feet, where the platform is on the order of two feet square. The stabilizers are designed to be of a "U" shape structure that enables the stabilizer to mate with the platform edge on three sides, as shown more particularly as D, E, and F in FIG. 4. This feature ensures that the stabilizers will be slidably stable by cooperative action of the surfaces of the platform and stabilizer at surfaces D, E and F, in conjunction with that of the stabilizer slot and platform pin 42. A frictional coefficient of moderate value between the platform and the stabilizer surfaces is sufficient to retain the stabilizer at a selected extended or retracted position relative to the platform.

The platform 10 is composed of plywood, plastic, aluminum, or other hard, durable, stiff material can be used for its composition. While the figures depict a substantially rectangular platform having four edges, platforms having other numbers of edges are possible, the least being three. The handle rotation feature is accomplished by use of two bracket members 22 and 24, for each handle respectively. A portion 43 of each bracket member is fixedly attached to one side of the platform 10 by means of common fasteners 44, such as rivets; however, other means, such as welding or gluing, are possible. The remaining portion 45 of the bracket members has a part cylindrical shape which covers the trapped portion 24, 26 of the handles so that they are held in proximity with the platform, while het being free to rotate relative to the platform. Guide pins 46 are provided on the handles which outwardly extend from the surface of the handles and interferingly engage the edge of the bracket members to prevent the handles from sliding translatably relative to the bracket members.

FIG. 5 shows the invention in the fully folded position, ready for easy transportation or storage. In this configuration, the stabilizers are preferably in a fully retracted position relative to the platform and the handles are rotated into a storage position characterized by being substantially in a plane parallel with that of the platform. In order that the handles may be rotated to a position as close as possible to the plane of the platform, it is necessary to translate one of the handles out of the way of the other. This is made possible by placing one guide pin 48 of the guide pins 46 a distance from the end of the bracket member equal to at least one diameter of the handle, as particularly shown in FIG. 5. To unfold the invention for use, first the handles are rotated to a deployed position characterized by being substantially perpendicular to the plane of the platforn, wherein the spring pins engage the apertures in the bracket members to fixedly retain the handles in this position. Next the stabilizers are extended.

In operation, the user would carry the invention in the above indicated folded configuration to a location in front of the planned seating location. The handles are first rotated out to the locked position. The stabilizers are then extended. The invention is thereupon positioned directly in front of the perspective seat, oriented so that the stabilizers face toward the seat. The width of the stabilizer spacing is such as to allow for insertion under the seat, avoiding interference with legs or other obstructions. The assist platform according to the invention is then positioned so that the stabilizers slide under the seat and the handles touch the front of the seat.

The user thereupon walks across the platform and sits down normally. To get up, the user grabs the handles, one in each hand, and pulls toward him or her as needed to rise. It should be noted that the user in the act of rising to a standing position would have his or her feet firmly on the platform, this will serve as an additional aid against the tendency of the platform to pitch up. Once standing, the user walks across the platform freely.

Because the platform is not in any way connected to the seat, it may be folded up at any time by pressing inwardly on the spring pins and then rotating the handles, followed by retracting of the stabilizers by pushing on them.

The preferred embodiment of the invention has incorporated on the underside of the platform a plurality of anti-skid strips 50.

To those skilled in the art to which this invention appertains, the above described preferred embodiment may be subject to change or modification. Such changes or modifications can be carried out without departing from the scope of the invention, which is intended to be limited only by the scope of the appended claims.

What is claimed is:

1. An assist to aid a person rising from a seated position, comprising:

a platform having two flat sides which define a plane, said platform having at least one edge;

of handles extending away from one of said flat sides of said platform, each handle of said pair of handles being separated from the other to allow a person to walk therebetween; and ward from said one edge of said platform in said plane for preventing tipping of said platform when said person rises from said seated position.

sion from said one edge of said platform; and further including means for retaining said stabilizer means in fixed orientation relative to both said plane and said one edge of said platform.

3. The assist of claim 2, wherein said stabilizer means is a pair of stabilizers each of which being located at opposite sides of said one edge of said platform.

4. The assist of claim 3, further comprising means connected with said platform and each handle of said pair of handles for rotatable attachment of each handle relative to said platform.

able attachment of each said handle of said pair of handles is a bracket member connected with each said handle, each said bracket member having a part cylindrical portion which traps a portion of its respective said handle in relation to said platform; further wherein said bracket member has at least one aperture; said trapped portion of each said handle having attached thereto a resiliently biased spring pin, said spring pin inserting into said aperture when each said respective handle is in a substantially perpendicular orientation relative to said platform.

Col. 7

8. An assist to aid a person rising from a seated position, comprising:

a platform having two flat sides defining a plane, said platform having edges forming substantially a rectangle;

a pair of stabilizers each of which being located at opposite ends of one edge of said edges of said platform and extending a predetermined length outward from said one edge in said plane;

means for varying the length of extension of said each stabilizer of said pair of stabilizers outward from said one edge of said platform;

means for retaining said stabilizers in fixed parallel relation to each other and in fixed perpendicular relation to said edge while varying said length of extension of each of said stabilizers;

a pair of handles, each handle of said pair of handles having a section angled relative to said platform at other than ninety degrees, each handle of said pair of handles being separated from each other to allow said person to walk therebetween, each handle of said pair of handles further being rotatably connected to said platform;

means connected with each said handle and said platform for rotatably connecting each handle of said pair of handles relative to said platform; and means connected with said platform and each said handle for releasably retaining each handle of said pair of handles in a fixed upright orientation relative to said platform.

9. Method for assisting a person to rise from a seated position, comprising:

providing a platform having a stabilizer and a pair of spaced apart handles in parallel relation to each other and spaced sufficiently far apart so as to allow said person to walk therebetween;

placing said platform immediately in front of a seating location with said handles and said stabilizer facing said seating location;

walking across said platform to said seating location and thereupon sitting down;

grabbing hold of a handle in each hand;

pulling on said handles while rising up; and walking across said platform away from said seating location.

* * * * *

UNITED STATES PATENT AND TRADEMARK OFFICE

CERTIFICATE OF CORRECTION

PATENT NO. : 4,843,661

DATED : July 4, 1989

INVENTOR(S) : Bernard J. Skibinski

It is certified that error appears in the above-identified patent and that said Letters Patent is hereby corrected as shown below:

In Claim 1, at Column 4, line 2, after "comprising:", delete the remainder of the claim and insert therefor:

—a platform having two flat sides which define a plane, said platform having at least one edge;

a pair of handles attached to said platform, said pair of handles extending away from one of said flat sides of said platform, each handle of said pair of handles being separated from the other to allow a person to walk therebetween; and stabilizer means attached to said platform, said stabilizer means extending a predetermined length outward from said one edge of said platform in said plane for preventing tipping of said platform when said person rises from said seated position.--

At Column 4, following Claim 1, insert Claim 2, as follows:

—2. The assist of Claim 1, wherein said stabilizer means includes means for varying the length of outward extension from said one edge of said platform; and further including means for retaining said stabilizer means in fixed orientation relative to both said plane and said one edge of said platform.--

In Claim 4, at Column 5, line 4, after "relative to said platform.", delete the remainder of the claim.

UNITED STATES PATENT AND TRADEMARK OFFICE

CERTIFICATE OF CORRECTION

PATENT NO. : 4,843,661

DATED : July 4, 1989

INVENTOR(S) : Bernard J. Skibinski

It is certified that error appears in the above-identified patent and that said Letters Patent is hereby corrected as shown below:

At Column 5, after Claim 4, insert Claims 5, 6 and 7 as follows:

—5. The assist of Claim 4, wherein said means for rotatable attachment of each said handle of said pair of handles is a bracket member connected with each said handle, each said bracket member having a part cylindrical portion which traps a portion of its respective said handle in relation to said platform; further wherein said bracket member has at least one aperture; said trapped portion of each said handle having attached thereto a resiliently biased spring pin, said spring pin inserting into said aperture when each said resepctive handle is in a substantially perpendicular orientation relative to said platform.

6. The assist of Claim 5, wherein each said handle has a section which is angled relative to said platform at other than ninety degrees for making easier and more efficient grabbing hold of each handle by said person.

7. The assist of Claim 6, wherein said handles are prevented from translational movement relative to said bracket member by a guide pin attached to each handle on either side of each said bracket member; and wherein further one of said guide pins is separated from said bracket member by a distance equal to at least one diameter of said handle for allowing limited translation of said handle relative to said bracket member so that said handles may be rotated to a position generally parallel to said plane

Signed and Sealed this

Twenty-sixth Day of June, 1990

*Attest:*

*Attesting Officer*

HARRY F. MANBECK, JR.

*Commissioner of Patents and Trademarks*